United States Patent [19]

Ohkoshi et al.

[11] 4,291,253

[45] Sep. 22, 1981

[54] GRID STRUCTURE FOR COLOR PICTURE TUBE

[75] Inventors: Akio Ohkoshi; Eiji Ishii, both of Tokyo; Akira Nakayama, Fuchu; Shoji Kato, Yokohama; Yoshiyuki Tanaka, Koganei, all of Japan

[73] Assignees: Sony Corporation; Sumitomo Metal Mining Co., Ltd., both of Tokyo, Japan

[21] Appl. No.: 946,377

[22] Filed: Sep. 27, 1978

[30] Foreign Application Priority Data

Sep. 30, 1977 [JP] Japan ..... 52-118425

[51] Int. Cl.[3] ..... H01J 1/46; H01J 29/07

[52] U.S. Cl. ..... 313/348; 313/269; 313/403

[58] Field of Search ..... 313/403, 407, 470, 456, 313/451, 255, 269, 348

[56] References Cited

U.S. PATENT DOCUMENTS 3,638,063 1/1972 Tachikawa et al. ..... 313/348

*Primary Examiner*—Robert Segal

*Attorney, Agent, or Firm*—Lewis H. Eslinger; Alvin Sinderbrand

[57] ABSTRACT

In a grid structure for a color picture tube of the type comprised of a pair of elongated frame elements disposed in substantially parallel, spaced apart relation at the top and bottom, respectively, of the grid structure, a pair of mechanically resilient brace members having mid-portions extending between the frame elements at the opposite sides of the grid structure and end portions affixed to the frame elements for maintaining the latter in their spaced apart relation, and a plurality of grid wires defining slits therebetween extending between the frame elements and being welded or otherwise affixed to the latter adjacent the opposite ends of the grid wires while the grid wires are longitudinally tensioned and the brace members are prestressed by forces acting on the frame elements in the directions to urge the frame elements toward each other; each brace member has a cross-sectional shape, such as, a rectangular shape, providing different section moduli in respect to correspondingly different axes passing through the centroid of the cross-sectional shape, and the mid-portion of each brace member is disposed so that an axis of the cross-sectional shape thereof which passes through the centroid at right angles to the axis about which there is a maximum section modulus is disposed in a plane containing the lines of action of the forces which act on the frame elements at predetermined points adjacent the respective end portions of the frame elements, for example, the points at which forces are applied to the frame elements for prestressing the brace members during the affixing of the grid wires to the frame elements.

15 Claims, 5 Drawing Figures

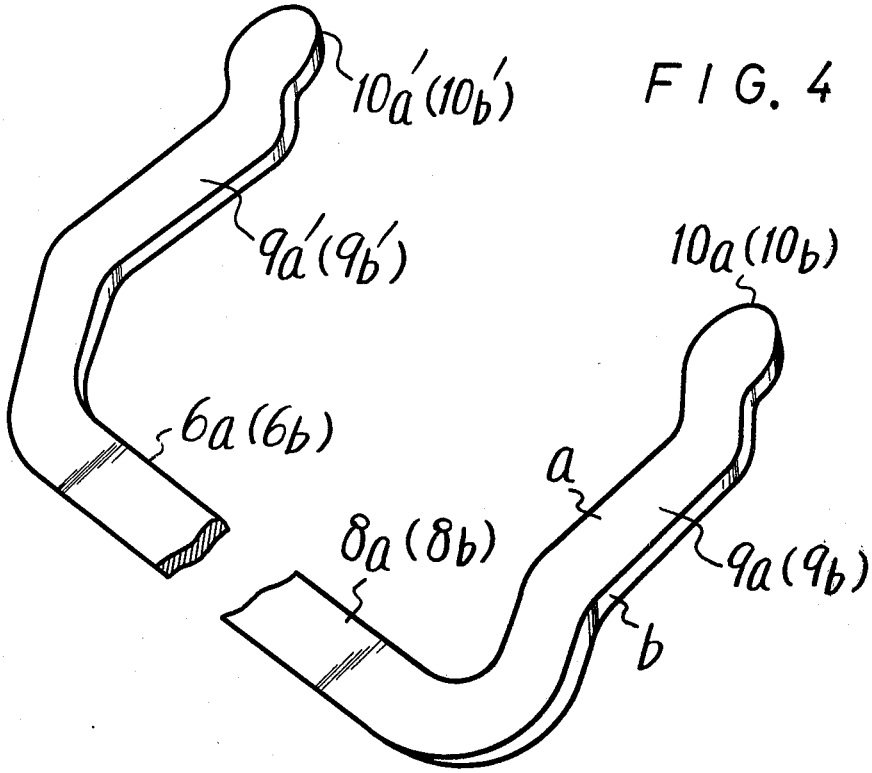
FIG. 4
FIG. 5
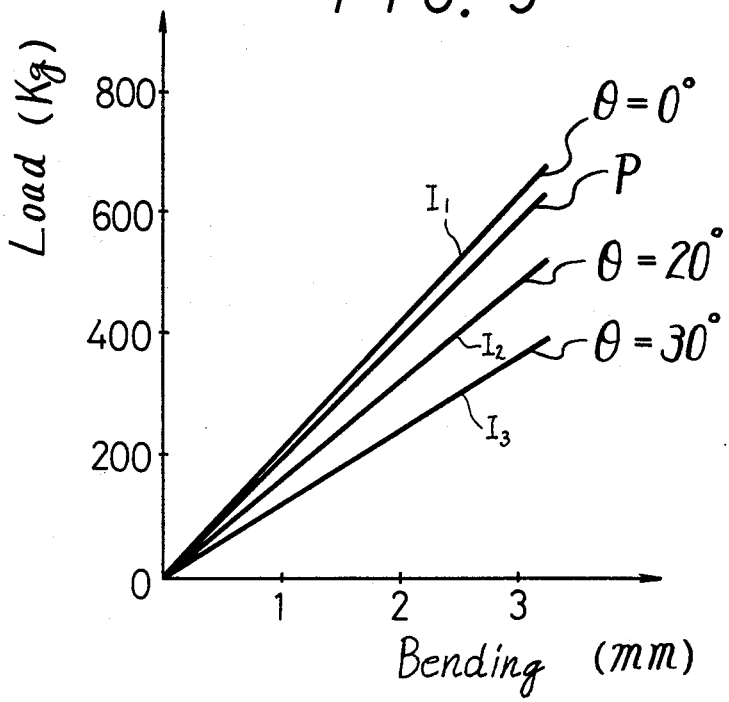

GRID STRUCTURE FOR COLOR PICTURE TUBE

BACKGROUND OF THE INVENTION

1. Field of the Invention

This invention relates generally to the grid structure for a color cathode ray tube, for example, the color picture tube of a color television receiver and more particularly is directed to providing an improved frame for such grid structure.

2. Description of the Prior Art

It has been proposed, for example, as disclosed in detail in U.S. Pat. No. 3,638,063, issued Jan. 25, 1972, and having a common assignee herewith, that a color cathode ray tube of the type having a screen composed of laterally successive arrays of vertical phosphor stripes emitting light of three different colors, respectively, when irradiated by three respective electron beams, for example, as in the color picture tubes of the Trinitron (Trademark) color television receivers available commercially from Sony Corporation should be provided with a grid structure comprised of a frame or support in which there is mounted a grid element defining a plurality of vertical grid wires with slits therebetween each corresponding to a respective array of the phosphor stripes and through which the three electron beams are intended to pass for irradiating or impinging upon the respective stripes. In such known grid structure, the frame is formed of a pair of elongated frame elements disposed in substantially parallel, spaced apart relation at the top and bottom, respectively, of the grid structure, and a pair of mechanically resilient brace members, preferably of C-shaped configuration, extending between the frame elements at the opposite sides of the grid structure for maintaining the frame elements in their spaced apart relation. The C-shaped brace members preferably have their ends secured to the frame elements substantially at the Bessel points of the frame elements, and, at the time when the grid wires are welded or otherwise affixed to the frame elements, the grid wires are longitudinally tensionsed and the brace members are prestressed by forces acting on the frame elements at predetermined points adjacent the end portions of the latter so as to urge the frame elements toward each other. By reason of the foregoing, after the grid wires have been affixed to the frame elements and the forces for prestressing the brace members have been removed from the frame elements, the grid wires are longitudinally tensioned in accordance with a predetermined pattern. Thus, for example, if the brace members are prestressed at the time of the welding of the grid wires to the frame elements by forces acting on the frame elements at points closer to the ends of the latter than the Bessel points or other locations at which the ends of the brace members are affixed to the frame elements, then the grid wires close to the opposite sides of the grid structure will have a greater longitudinal tension applied thereto than the grid wires in the central portion of the grid structure. The foregoing distribution of longitudinal tensions in the grid wires ensures that, when the color cathode ray or picture tube is subjected to an impact or vibration, the resulting vibration of the grid wires will have a smaller amplitude adjacent the opposite side portions of the grid structure than at the center thereof, as is known to be desirable since the electron beams travel over greater distances when impinging on the side portions of the screen than at the center of the latter.

It will be appreciated that, during operation of the described color cathode ray or picture tube, the electron beams, in scanning the screen, also irradiate the grid wires and, as a result thereof, the temperature of the grid wires is raised to approximately 100° C. to 130° C. so that the grid wires are subjected to thermal expansion. However, the thermal expansion of the grid wires is accompanied by a more or less corresponding expansion of the prestressed brace members with the result of the desired longitudinal tensioning of the grid wires is substantially maintained.

In order to perform in the above-described manner, the frame of the prior art grid structure has to have a high mechanical strength, particularly for withstanding the prestressing of the brace members required to maintain the desired longitudinal tension in the grid wires when the latter are subjected to substantial thermal expansion. In order to achieve such high mechanical strength, the frame of the prior art grid structure has been made of steel, such as carbon steel and the like, and has been given relatively large cross-sectional areas so as to be of relatively great weight, particularly in the case of a grid structure for use in a large cathode ray tube. In order to reduce the weight of the grid structure according to the prior art, it has been proposed to form parts of the frame, for example, the brace members thereof of hollow metal tubing which may be of circular cross section. It will be appreciated that a hollow metal tube or cylinder of circular cross section has the same section modulus about all of its axes passing through the centroid of its circular cross-section. Further, when the hollow tube or cylinder is compared with a solid member of the same cross-sectional area and weight, the hollow tube or cylinder is found to have a substantially greater maximum section modulus or, conversely, a hollow tube or cylinder of substantially smaller cross-sectional area and weight than a solid member can be provided with the same section modulus as the latter. Thus, the prior art grid structure having the brace members of its frame formed of hollow metal tubing of circular cross section can have a sufficiently high mechanical strength without being excessively heavy.

However, the hollow metal tubing for forming the brace members of the known grid structure is substantially more expensive than corresponding structural elements of solid material and such increased cost is rather large when the metal tubing has an outer diameter smaller than 20 mm so as to require numerous steps for its manufacture. Moreover, when the brace members or other structural elements of the frame included in the known grid structure are formed of hollow metal tubing, there is the danger that air remaining within such metal tubing after the envelope of the cathode ray tube has been evacuated and sealed will leak or escape into the envelope so as to disturb the vacuum required therein. Therefore, when using the prior art grid structure having its brace members formed of hollow metal tubing, it has been necessary to either carefully evacuate all of the air from the metal tubing or to completely weld closed each end of the metal tubing when welding the brace members to the frame elements. Such welding of the metal tubing forming the brace members is time consuming and costly.

OBJECTS AND SUMMARY OF THE INVENTION

Accordingly, it is an object of this invention to provide a grid structure for a color cathode ray or picture tube which is free of the above-described defects inherent in the prior art.

More particularly, it is an object of this invention to provide a grid structure for a color picture tube which has a frame of the requisite strength and yet may be relatively inexpensive and light in weight.

Another object is to provide a grid structure comprised of a pair of elongated frame elements disposed in substantially parallel, spaced apart relation, a pair of mechanically resilient brace members extending between the frame elements for maintaining the latter in their spaced apart relation, and a plurality of grid wires with slits therebetween extending between the frame elements and being affixed to the latter adjacent the opposite ends of the grid wires with the brace members being prestressed so as to urge the frame elements away from each other and thereby longitudinally tension the grid wires, and in which the mechanically resilient brace members have solid cross sections so as to be relatively inexpensive, while the cross-sectional areas of the brace members are relatively small so as to provide the grid structure with a low weight which, for example, is comparable to that of grid structures having brace members formed of hollow metal tubing.

In accordance with an aspect of this invention, each of the mechanically resilient brace members of the grid structure for a color picture tube has a cross-sectional shape with different section moduli in respect to correspondingly different axes passing through the centroid of the cross-sectional shape, for example, each brace member has a solid rectangular cross-sectional shape.

Further, in accordance with the invention, the mid-portion of each of the brace members is disposed so that an axis of its cross-sectional shape which passes through the centroid thereof at right angles to the axis about which there is a maximum section modulus of the cross-sectional shape is disposed in a plane which contains the lines of action of forces acting on the frame elements at predetermined points adjacent the respective end portions of the frame elements, and by which maximum stressing of the mid-portions of the brace members occurs. Thus, in the case where, at the time of the welding or affixing of the grid wires to the frame elements, the grid wires are longitudinally tensioned and the brace members are prestressed by forces acting on the frame elements at predetermined points adjacent the end portions of the latter so as to urge said frame elements toward each other, the mid-portion of each of the brace members is disposed so that the axis of its cross-sectional shape which passes through the centroid thereof at right angles to the axis about which there is a maximum section modulus of the cross-sectional shape is disposed in a plane which contains the lines of action of said forces acting on the frame elements at said predetermined points adjacent the respective end portions of the frame elements.

The above, and other objects, features and advantages of the invention, will be apparent in the following detailed description of an illustrative embodiment which is to be read in conjunction with the accompanying drawings.

BRIEF DESCRIPTION OF THE DRAWINGS

FIG. 4 is a perspective view, which is partly broken away and in section, of one of the mechanically resilient brace members included in the grid structure of FIG. 2; and FIG. 5 is a graph showing the strength of the frame of a grid structure according to this invention as compared with the strength of frames which do not incorporate the invention.

DESCRIPTION OF THE PREFERRED EMBODIMENT

Figure 2:
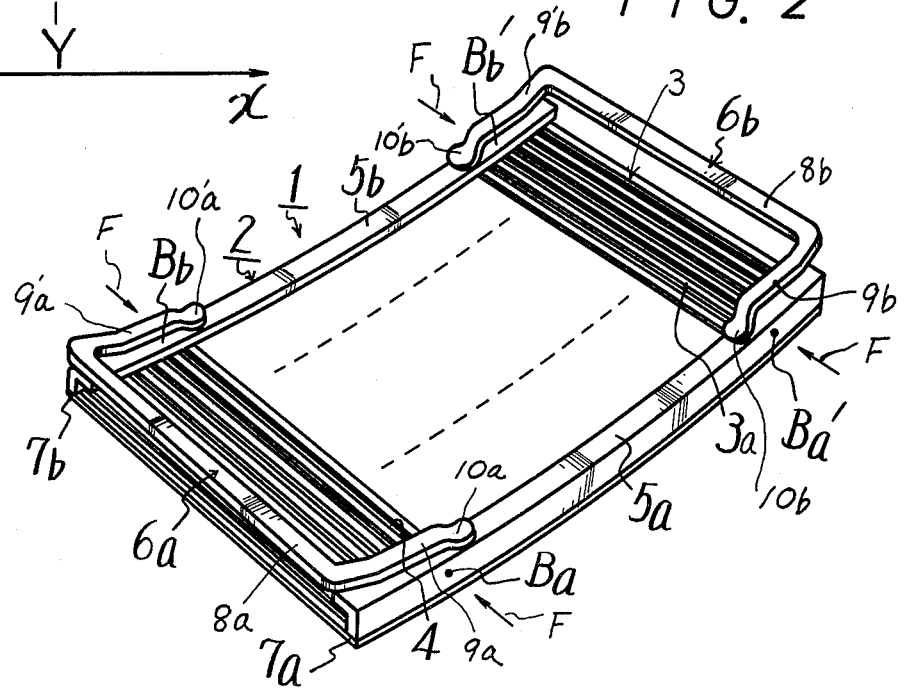
FIG. 2 is a perspective view showing the back side of a grid structure according to an embodiment of the invention.

Referring to the drawings in detail, and initially to FIG. 2 thereof, it will be seen that the invention is there shown applied to a grid structure 1 of the type which generally comprises a frame 2 and a grid element 3 having a large number of parallel grid wires 3*a* with slits 4 therebetween. The grid element 3 may be conventionally formed of a conductive metal plate or sheet which is suitably etched so as to form the slits 4 therein which separate the adjacent grid wires 3*a* constituted by the remaining portions of the metal plate or sheet. The frame 2 is shown to generally include a pair of elongated frame elements 5*a* and 5*b* which extend laterally in substantially parallel, spaced apart relation at the top and bottom, respectively, of grid structure 1 when the latter is in its position of use in a color cathode ray tube or picture tube (not shown). Frame 2 further includes a pair of mechanically resilient brace members 6*a* and 6*b* which extend between frame elements 5*a* and 5*b* at the opposite sides of grid structure 1 for maintaining frame elements 5*a* and 5*b* in spaced apart relation.

Each of the frame elements 5*a* and 5*b* is shown to be of L-shaped cross-section, that is, to present flanges at right angles to each other, and may be conveniently formed by suitably bending or pressing an elongated, initially flat or planar plate or carbon steel or the like. The frame elements 5*a* and 5*b* are arranged so that flanges thereof extend toward each other at the back of elements 5*a* and 5*b*, while end faces 7*a* and 7*b* of the other or forwardly directed flanges of the L-shaped cross sections of elements 5*a* and 5*b* are adapted to have the top and bottom edge portions of grid element 3 affixed thereto, as by welding.

The brace members 6*a* and 6*b* are shown to be substantially of C-shaped configuration so as to have mid-portions 8*a* and 8*b*, respectively, which extend between frame elements 5*a* and 5*b* adjacent the respective ends of the latter. The C-shaped brace member 6*a* is further shown to have end portions 9*a* and 9'*a* extending from mid-portion 8*a* substantially at right angles to the latter and having ends 10*a* and 10'*a*, respectively, which are welded to the back surfaces of frame elements 5*a* and 5*b* at locations spaced inwardly from the respective ends of the frame elements. Similarly, brace member 6*b* has end portions 9*b* and 9'*b* extending at right angles from its mid-portion 8*b* and having ends 10*b* and 10'*b* welded to the back surfaces of frame elements 5*a* and 5*b* at locations thereon spaced inwardly from the respective ends of the frame elements. As is known, the locations on frame elements 5*a* and 5*b* at which ends 10*a* and 10′*a* and ends 10*b* and 10′*b* of brace members 6*a* and 6*b*, respectively, are welded or secured to the frame elements may be substantially at the Bessel points of the frame elements or, if desired, spaced from such Bessel points in the directions toward the adjacent ends of the frame elements.

In any case, when producing grid structure 1, the frame 2 thereof is first produced as a sub-assembly by welding or affixing brace members 6*a* and 6*b* to frame elements 5*a* and 5*b*. Thereafter, forces indicated by arrows F on FIG. 2 are applied to frame elements 5*a* and 5*b* at predetermined points B and B′ adjacent the end portions of frame element 5*a* and at predetermined points $B_b$ and $B'_b$ adjacent the end portions of frame element 5*b* in directions to urge frame elements 5*a* and 5*b* toward each other and thereby prestress brace members 6*a* and 6*b* in compression and bending, particularly in their mid-portions 8*a* and 8*b*. While brace members 6*a* and 6*b* are thus prestressed, grid element 3 is tensioned in the longitudinal direction of its grid wires 3*a* and the edge portions of the top and bottom of the tensioned grid element 3 are welded or otherwise affixed to the end edge faces 7*a* and 7*b* of frame elements 5*a* and 5*b*. It will be appreciated that, after grid wires 3*a* have been welded or affixed to frame elements 5*a* and 5*b* and the forces F for prestressing brace members 6*a* and 6*b* have been removed from frame elements 5*a* and 5*b*, grid wires 3*a* continue to be longitudinally tensioned in accordance with a pattern determined by the locations at which the ends of brace members 6*a* and 6*b* are secured or welded to frame elements 5*a* and 5*b* and the points at which forces F were applied to the frame elements 5*a* and 5*b* during the welding of grid element 3 to frame elements 5*a* and 5*b*. Thus, during the operation of a color cathode ray or picture tube with the grid structure 1 therein, the thermal expansion of grid wires 3*a* resulting from the irradiation and consequent heating thereof by the scanning electron beams will be accompanied by the movement of frame elements 5*a* and 5*b* in directions away from each other under the urging of the prestressing brace member 6*a* and 6*b* so that the desired longitudinal tensioning of grid wires 3 will be substantially maintained.

From the foregoing, it will be appreciated that the maximum or critical stressing of brace members 6*a* and 6*b* occurs as a result of the forces F applied to frame elements 5*a* and 5*b* during the welding of tensioned grid element 3 to the frame elements, and that the stresses in the mid-portions 8*a* and 8*b* of brace members 6*a* and 6*b* are reduced in repsonse to thermal expansion of the grid wires 3*a* with operation of the color picture tube containing grid structure 1. Furthermore, it will be appreciated that the maximum stressing of brace members 6*a* and 6*b* occurs in response to the forces F giving rise to bending moments that act on brace members 6*a* and 6*b* predominently in certain directions or planes. Thus, in the grid structure 1 according to this invention, brace members 6*a* and 6*b* are formed of a solid material, for example, suitably shaped bands of carbon steel of rectangular cross section, and, particularly at the mid-portions 8*a* and 8*b* of the brace members, the rectangular cross-section is oriented so as to be best able to tolerate the maximum bending moments applied to brace members 6*a* and 6*b*.

If one considers any arbitrary cross-sectional shape or configuration of a body, it will be appreciated that, in such cross-sectional configuration, there are two main axes passing through a point about which the moments of inertia of the area (more properly called second moments of area) are maximum and minimum, respectively. These two main axes intersect at right angles to each other, and the product of inertia about the main axes is zero. If the point at which the main axes intersect coincides with the centroid of the cross-sectional configuration, the main axes of the moments of inertia or second moments of area become the main axes of the area itself. If the cross-sectional configuration is symmetrical, one of the symmetrical axes becomes a main axis and the other intersects the main axis at right angles. If the cross-sectional configuration is a circle, the values of the moment of inertia of area are the same for any axis passing through the centroid of the cross-sectional configuration, and hence there are an infinite number of main axes. However, in the case of other cross-sectional configurations, for example, rectangles, the value of the section modulus varies between a maximum value and a minimum value in dependence upon the direction of the axis about which the section modulus is considered. The axes about which the moments of inertia of area have maximum and minimum values, respectively, will be the axes about which the section moduli have maximum and minimum values, respectively.

Figure 1:
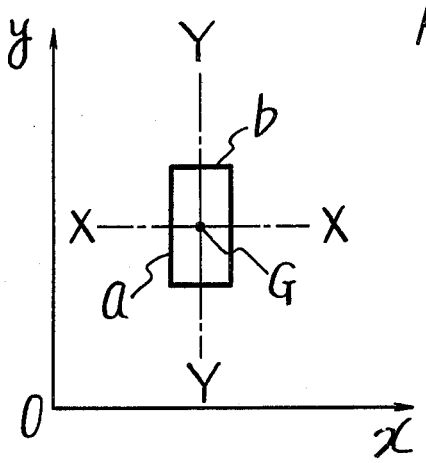
FIG. 1 is a schematic diagram to which reference will be made in explaining the present invention.

Referring now to FIG. 1, in which a rectangular cross-section of a body is illustrated with its long and short sides a and b extending parallel to the ordinate and abscissa y and x, respectively, an axis X—X passing through a centroid G of the rectangular cross-section is parallel to the short side b and is shown to be perpendicular to an axis Y—Y which passes through the centroid G parallel to the long side a. In the case of the rectangular cross section shown on FIG. 1, the values of the moment of inertia of an area (or the second moments of area) about the axis X—X and about the axis Y—Y are maximum and minimum, respectively. Similarly, the section moduli of the rectangular cross-section shown on FIG. 1 are maximum about the axis X—X and minimum about the axis Y—Y.

In accordance with the present invention, each of the resilient brace members 6*a* and 6*b* is formed with a cross-sectional configuration or shape, for example, a rectangular cross-section as shown on FIG. 1, so as to have a maximum section modulus about the axis X—X and a minimum section modulus about the axis Y—Y at right angles to the axis X—X. Further, in accordance with the invention, each of the resilient brace members 6*a* and 6*b* is arranged, particularly at its mid-portion 8*a* or 8*b*, so that the maximum section modulus will be available to resist the maximum bending moment acting on the brace member. As previously noted, such maximum bending moment acting on the brace member 6*a* or 6*b* results from the forces F applied to the points $B_a$ and $B_b$ or $B'_a$ and $B'_b$, respectively, of frame elements 5*a* and 5*b* for presetting the resilient brace member 6*a* and 6*b* at the time of welding of grid element 3 to the frame 2. It will be appreciated that the directions in which the maximum bending moments act on brace members 6*a* and 6*b* are important in determining the strength of frame 2, and that the directions in which the maximum bending moments act are determined by the positional relationship of the points $B_a$, $B'_a$, $B_b$ and $B'_b$ at which the forces F are applied to frame elements 5*a* and 5*b* and the resilient brace members 6*a* and 6*b*. The influence of such positional relationship on the strength of frame 2 is graphically illustrated on FIG. 5 where the ordinate represents the load applied to the frame of the grid structure by the forces indicated at F on FIG. 2, and the abscissa indicates the bending of the brace members measured as the movement of the frame elements 5*a* and 5*b* toward each other in response to the various loads. On FIG. 5, the line $I_1$ represents the strength of grid structure 1 according to this invention in which the brace members 6*a* and 6*b* are shaped and disposed as shown in full lines on FIG. 1. More particularly, in accordance with the present invention, each of the brace members 6*a* and 6*b* has the rectangular cross section of its mid-portion 8*a* or 8*b*, respectively, disposed so that the axis Y—Y of the rectangular cross-section which passes through the centroid G at right angles to the axis X—X about which there is the maximum section modulus of the rectangular cross section is disposed in a plane M which contains the lines of action of forces acting on the frame elements 5*a* and 5*b* at predetermined points B adjacent the respective end portions of the frame elements. The points B on FIG. 3 may substantially correspond to the points $B_a$ and $B_b$ and the points $B'_a$ and $B'_b$ at which the forces F are applied to frame elements 5*a* and 5*b* for prestressing brace members 6*a* and 6*b* at the time when grid element 3 is welded to frame 2, as such forces F usually produce the maximum bending moments and stresses in the brace members.

When each of the brace members 6*a* and 6*b* has its mid-portion 8*a* or 8*b* arranged so that the axis Y—Y of its rectangular cross-section substantially coincides with the plane M in accordance with the present invention, that is, the angle $\theta$ between its axis Y—Y and the plane M is substantially zero, the strength of the frame as represented by the line $I_1$ on FIG. 5 is even somewhat greater than the strength of the frame of a grid structure according to the prior art represented by the line P on FIG. 5, and in which the brace members corresponding to the brace members 6*a* and 6*b* are formed of hollow metal tubing of the same material and cross-sectional area as the brace members 6*a* and 6*b*. In other words, the line $I_1$ on FIG. 5 represents the strength of the frame of a grid structure according to the present invention having its brace members 6*a* and 6*b* each formed of a solid band of rectangular cross-section of an area equal to the cross-sectional area of the hollow metal tubing of circular cross section used for the brace members of the prior art grid structure represented by line P on FIG. 5.

Figure 3:
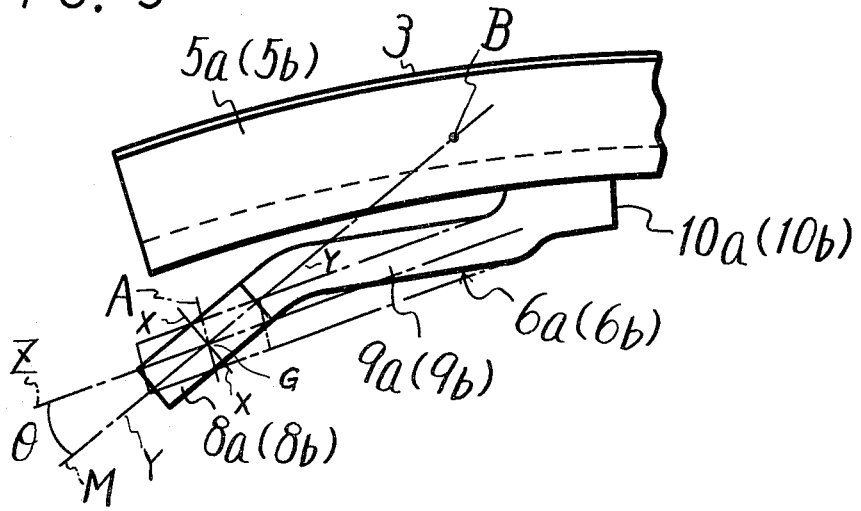
FIG. 3 is a fragmentary elevational view showing a side portion of the grid structure of FIG. 2 on an enlarged scale.

If, contrary to the present invention, brace members formed of bands of rectangular cross section have their mid-portions arranged, for example, as indicated in broken lines on FIG. 3, so that there is a substantial angle $\theta$ between the plane M containing the lines of action of forces acting on the frame elements at the points B and the axis Z of the rectangular cross section which is perpendicular to the axis A about which there is a maximum section modulus, than the strength of the frame in respect to forces applied to the points B will be substantially reduced. For example, as indicated by the lines $I_2$ and $I_3$ on FIG. 5, grid structures having brace members with solid, rectangular cross-sections, but in which the angle $\theta$ is 20° and 30°, respectively, will be less strong than either the grid structure frame according to the present invention, as represented by the line $I_1$, or the prior art grid structure frame represented by the line P.

It will be appreciated that, in the frame of a grid structure according to this invention, it is not necessary that the angle $\theta$ be limited to zero. In other words, the axis Y—Y of the rectangular cross section in the mid-portion of each of the brace members 6*a* and 6*b* may be at a small angle in respect to the plane M so long as the resulting frame strength is nevertheless at least equal to the strength of a corresponding frame in which the brace members are formed of hollow metal tubing of circular cross section having the same cross-sectional area as the solid rectangular cross sections of the brace members 6*a* and 6*b* of the grid structure 1 according to this invention.

It will be appreciated that, in addition to the bending moment acting in plane M, the forces applied at points B on FIG. 3 also give rise to distortion moments acting on end portions 9*a*, 9'*a*, 9*b* and 9'*b* of brace members 6*a* and 6*b*. In order to minimize such distortion moments, it is desirable that end portions 9*a*, 9'*a* and 9*b*, 9'*b* extending from mid-portions 8*a* and 8*b*, respectively, of brace members 6*a* and 6*b* be disposed substantially parallel to the adjacent portions of frame elements 5*a* and 5*b*, as particularly shown on FIG. 3, with a gap or clearance being provided between such end portions 9*a*, 9'*a* and 9*b*, 9'*b* and the adjacent portions of frame elements 5*a* and 5*b* so as to avoid the accumulation of dust or lint therebetween.

As is particularly shown on FIG. 4, the ends 10*a*, 10'*a* and 10*b*, 10'*b* of brace members 6*a* and 6*b* are preferably formed with semi-circular shapes so as to be suitable for welding to frame elements 5*a* and 5*b* by a rotary-type torch. Since each of the brace members 6*a* and 6*b* is formed of a solid band of material, the extent of such welding is dictated only by the required strength of attachment of each brace member to frame elements 5*a* and 5*b*. The foregoing is distinguished from the prior art in which, by reason of the hollow character of the metal tubing used for the brace members, each end of the brace member has to be welded along its entire edge for sealing the tube whether or not that much welding is necessary to provide a requisite strength of attachment of the brace member to the frame elements.

It will be appreciated from the above that, if the mechanically resilient brace members 6*a* and 6*b* of the grid structure 1 according to this invention have a solid cross-sectional shape, for example, the illustrated rectangular cross-section, such that the cross-sectional area and the maximum section modulus thereof can be made approximately the same as the cross-sectional area and section modulus of the hollow metal tubing of circular cross section used in the brace members of grid structures according to the prior art, then the frame 2 of grid structure 1 according to this invention will have approximately the same strength as the prior art frame using the hollow metal tubing and can be similarly relatively light in weight. However, since the brace member 6*a* and 6*b* of the grid structure 1 according to this invention can be simply of rectangular cross-section and solid, such brace members can be easily and inexpensively manufactured, for example, by a press or the like, from flat carbon steel plate or bar stock. It will be apparent that such carbon steel plate or bar stock can be easily produced by drawing, extruding, rolling and the like, so that it can be inexpensively produced, as compared with the relatively high costs involved in the manufacture of hollow metal tubing of circular cross section. Although the brace members 6*a* and 6*b* of the grid structure 1 according to this invention have been described and shown as having rectangular cross sections, such brace members may have other cross-sectional shaped so long as the latter provide different section moduli in respect to different axes passing through the centroid of the cross-sectional shape.

Having described an illustrative embodiment of the invention with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. A grid structure for a color picture tube, comprising:

a pair of elongated frame elements disposed in substantially parallel, spaced apart relation;

a pair of mechanically resilient brace members extending between said frame elements for maintaining the latter in said spaced apart relation;

means defining a plurality of grid wires with slits therebetween which extend between said frame elements and which are affixed to the latter adjacent the opposite ends of the grid wires with said brace members being prestressed so as to urge said frame elements away from each other and thereby longitudinally tension said grid wires;

each of said brace members including a mid-portion and end portions extending from the latter and being affixed to said frame elements at locations on the latter spaced inwardly from respective ends of said frame elements, each of said brace members further having a cross-sectional shape with different section moduli in respect to correspondingly different axes passing through the centroid of said cross-sectional shape, said mid-portion of each of the brace members being disposed so that an axis of said cross-sectional shape which passes through said centroid at right angles to the axis about which there is a maximum section modulus of said cross-sectional shape is disposed in a plane which contains the lines of action of forces acting on said frame elements at predetermined points adjacent the respective end portions of the frame elements.

2. A grid structure according to claim 1; in which said cross-sectional shape of each of the brace members is rectangular so that said maximum section modulus is obtained about the minor axis of said rectangular cross-sectional shape and the major axis of said rectangular shape is disposed in said plane.

3. A grid structure according to claim 1; in which each of said brace members has a solid cross-section.

4. A grid structure according to claim 1; in which said locations on the frame elements at which said end portions of the brace members are affixed thereto are substantially at the Bessel points of the frame elements.

5. A grid structure according to claim 4; in which said predetermined points at which said forces act on the frame elements are closer to the ends of said frame elements than are said locations on the frame elements at which said end portions of the brace members are affixed thereto.

6. A grid structure for a color picture tube, comprising:

a pair of elongated frame elements disposed in substantially parallel, spaced apart relation;

a pair of mechanically resilient brace members extending between said frame elements for maintaining the latter in said spaced apart relation;

means defining a plurality of grid wires with slits therebetween which extend between said frame elements and which are affixed to the latter adjacent the opposite ends of the grid wires while the grid wires are longitudinally tensioned and said brace members are prestressed by forces acting on said frame elements at predetermined points adjacent the end portions of the latter so as to urge said frame elements toward each other; and each of said brace members including a mid-portion and end portions extending from the latter and being affixed to said frame elements at locations on the latter spaced inwardly from respective ends of said frame elements, each of said brace members further having a cross-sectional shape with different section moduli in respect to correspondingly different axes passing through the centroid of said cross-sectional shape, said mid-portion of each of the brace members being disposed so that an axis of said cross-sectional shape which passes through said centroid at right angles to the axis about which there is a maximum section modulus of said cross-sectional shape is disposed in a plane which contains the lines of action of said forces acting on said frame elements at said predetermined points adjacent the respective end portions of the frame elements.

7. A grid structure according to claim 6; in which said cross-sectional shape of each of the brace members is rectangular so that said maximum section modulus is obtained about the minor axis of said rectangular cross-sectional shape and the major axis of said rectangular shape is disposed in said plane.

8. A grid structure according to claim 6; in which each of said brace members has a solid cross-section.

9. A grid structure according to claim 6; in which said locations on the frame elements at which said end portions of the brace members are affixed thereto are substantially at the Bessel points of the frame elements.

10. A grid structure according to claim 6; in which each of said brace members is generally C-shaped so that said end portions extend substantially at right angles to the respective mid-portion, and said end portions of each brace member are longitudinally shaped to extend in substantially parallel, spaced relation to the adjacent frame elements along substantial parts of the lengths of said end portions.

11. A grid structure according to claim 10; in which said predetermined points at which said forces act on the frame elements for prestressing the brace members are closer to the ends of said frame elements than are said locations on the frame elements at which said end portions of the brace members are affixed thereto.

12. A grid structure according to claim 11; in which said locations on the frame elements at which said end portions of the brace members are affixed thereto are substantially at the Bessel points of the frame elements.

13. A grid structure according to claim 12; in which each of said brace members has a solid cross-section.

14. A grid structure according to claim 13; in which said cross-sectional shape of each of the brace members is rectangular.

15. A grid structure according to claim 6; in which each of said brace members has a solid cross-section with said shape thereof being rectangular, and each of said brace members is generally C-shaped so that said end portions thereof extend substantially at right angles to the respective mid-portion.

* * * * *